US010267574B2

(12) United States Patent
Oliva et al.

(10) Patent No.: US 10,267,574 B2
(45) Date of Patent: Apr. 23, 2019

(54) HEAT EXCHANGER

(71) Applicant: Hemlock Semiconductor Corporation, Hemlock, MI (US)

(72) Inventors: John C. Oliva, Laingsburg, MI (US); Brad Werner, Bay City, MI (US); Michael Zalar, Midland, MI (US)

(73) Assignee: HEMLOCK SEMICONDUCTOR OPERATIONS LLC, Hemlock, MI (US)

( * ) Notice: Subject to any disclaimer, the term of this patent is extended or adjusted under 35 U.S.C. 154(b) by 537 days.

(21) Appl. No.: 14/894,776

(22) PCT Filed: Jun. 11, 2014

(86) PCT No.: PCT/US2014/041908

§ 371 (c)(1),
(2) Date: Nov. 30, 2015

(87) PCT Pub. No.: WO2014/201116

PCT Pub. Date: Dec. 18, 2014

(65) Prior Publication Data

US 2016/0131443 A1 May 12, 2016

Related U.S. Application Data

(60) Provisional application No. 61/833,812, filed on Jun. 11, 2013.

(51) Int. Cl.

| | |
|---|---|
| ***F28F 7/02*** | (2006.01) |
| ***F28F 9/02*** | (2006.01) |
| ***F28F 13/08*** | (2006.01) |

(52) U.S. Cl.

CPC ..... *F28F 7/02* (2013.01); *F28F 9/02* (2013.01); *F28F 9/0278* (2013.01); *F28F 9/0282* (2013.01); *F28F 13/08* (2013.01)

(58) Field of Classification Search

CPC ..... F28F 9/02; F28F 9/0278; F28F 9/0282; F28F 9/026; F28F 9/0253; F28F 9/0251;

(Continued)

(56) References Cited

U.S. PATENT DOCUMENTS 1,571,068 A * 1/1926 Stancliffe ..... F28D 7/0025 122/32
3,272,260 A * 9/1966 Raub ..... F28F 7/02 165/164

(Continued)

FOREIGN PATENT DOCUMENTS

CN 1527742 A 9/2004
CN 101218019 A 7/2008

(Continued)

OTHER PUBLICATIONS

Office Action regarding related CN App. No. 201480031786.1; dated Dec. 21, 2016; 9 pgs.

(Continued)

*Primary Examiner* — Tho V Duong
(74) *Attorney, Agent, or Firm* — Cantor Colburn LLP

(57) ABSTRACT

A heat exchanger transfers heat between first and second material streams. The heat exchanger includes a body portion including vent channels configured to pass the first material stream through the body portion. The body portion further includes feed channels configured to pass the second material stream through the body portion. The feed channels are spaced from and in thermal communication with the vent channels such that at least one of the first and second material streams transfer heat with another one of the first and second material streams. Each of the feed channels has an inlet having a crosssectional area with the cross-sectional area of the inlet of at least one of the feed channels different than the cross-sectional area of the inlet of another one of the (Continued)

feed channels for normalizing a flow rate of the second material stream through the feed channels.

14 Claims, 11 Drawing Sheets

(58) Field of Classification Search
CPC .. F28F 13/08; F28F 1/006; F28F 1/025; F28F 7/02; F28F 2009/0287; G21D 3/14
See application file for complete search history.

(56) References Cited

U.S. PATENT DOCUMENTS

| | | | | |
|---|---|---|---|---|
| 4,156,625 | A * | 5/1979 | Wachendorfer, Sr. | F28F 7/02 156/245 |
| 5,590,708 | A * | 1/1997 | Ulrich | F24H 9/165 165/165 |
| 7,011,149 | B2 | 3/2006 | Fujita et al. | |
| 7,285,153 | B2 * | 10/2007 | Bruun | F23C 13/00 165/165 |
| 8,685,365 | B2 * | 4/2014 | Mathias | B01J 19/0093 422/130 |
| 2003/0016638 | A1 * | 1/2003 | Philips | B01J 19/0093 370/329 |
| 2004/0261379 | A1 | 12/2004 | Bruun | |
| 2009/0056924 | A1 * | 3/2009 | Inatomi | F28F 7/02 165/165 |
| 2010/0270011 | A1 | 10/2010 | Takahashi | |
| 2011/0220332 | A1 * | 9/2011 | Abenaim | B01J 19/0093 165/164 |
| 2013/0213620 | A1 | 8/2013 | Miyazaki et al. | |

FOREIGN PATENT DOCUMENTS

| | | | | |
|---|---|---|---|---|
| CN | 101432075 | A | 5/2009 | |
| CN | 202229631 | U | 5/2012 | |
| DE | 102004054334 | A1 * | 5/2006 | B01J 19/0093 |
| EP | 2246539 | A2 | 11/2010 | |
| JP | S6349181 | B2 | 10/1988 | |
| JP | 2002107072 | A | 4/2002 | |
| JP | 2007170271 | A | 7/2007 | |
| JP | 2013057426 | A | 3/2013 | |
| WO | 02051538 | A1 | 7/2002 | |
| WO | 2012043758 | A1 | 2/2014 | |

OTHER PUBLICATIONS

Office Action regarding related JP App. No. 519,613/2016, dated Nov. 14, 2017; 7 pgs.
Translation of Office Action regarding related TW App. No. 103119635; dated Jul. 10, 2017; 14 pgs.
International Search Report regarding related PCT App. No. PCT/US2014/041908; dated Sep. 12, 2014; 4 pgs.
Written Opinion regarding related PCT App. No. PCT/US2014/041908; dated Sep. 12, 2014; 4 pgs.

* cited by examiner

HEAT EXCHANGER

CROSS REFERENCE TO RELATED APPLICATIONS

This application claims priority to and all advantages of PCT Application No. PCT/US2014/041908, filed Jun. 11, 2014, which claims priority to U.S. Provisional Patent Application No. 61/833,812, filed on Jun. 11, 2013, the content of each of the above incorporated herein by reference in their entireties.

TECHNICAL FIELD

Disclosed herein is a heat exchanger. More specifically, the subject invention relates to a heat exchanger having a plurality of feed channels and a plurality of vent channels for transferring heat between first and second material streams.

BACKGROUND

Heat exchangers with multiple channels for transferring heat between first and second material streams are known. However, as flow rates of the material streams increase, which is typical in industrial equipment where processes are continuously pushed to increase capacity, a majority of the material streams utilizes only a minority of the channels. Said differently, as the flow rate of the material streams increases, the distribution of the material streams between the channels decreases leaving some of the channels almost completely unutilized. The non-uniform distribution of the material streams within the channels decreases an efficiency of the heat exchangers because an active surface area of the heat exchangers and a residence time of the material streams within the heat exchanger are reduced. Therefore, there remains a need to improve the efficiency of heat exchanges while increasing the flow rate of the material streams through the heat exchangers.

SUMMARY

A heat exchanger is used to transfer heat between first and second material streams. The heat exchanger includes a body portion comprising a thermally conductive material. The body portion also includes a plurality of vent channels defined through the body portion with the vent channels configured to pass the first material stream through the body portion. The body portion further includes a plurality of feed channels defined through the body portion. The feed channels are configured to pass the second material stream through the body portion. The feed channels are spaced from and in thermal communication with the vent channels such that at least one of the first and second material streams transfer heat with another one of the first and second material streams within the body portion. Each of the feed channels has an inlet for allowing the second material stream to enter the feed channels. The inlet has a cross-sectional area with the cross-sectional area of the inlet of at least one of the feed channels different than the cross-sectional area of the inlet of another one of the feed channels for normalizing a flow rate of the second material stream through the feed channels of the body portion. Normalizing the flow rate of the first material stream through the feed channels increases an efficiency of the heat exchanger.

A reactor system is used for processing a feed gas. The reactor system includes a reaction chamber having an entrance port for introducing a second material stream comprising the feed gas into said reaction chamber and an exhaust port for exhausting a first material stream from the reaction chamber after processing of the feed gas of the second material stream; a heat exchanger having a body portion comprising a thermally conductive material, said body portion comprising; a plurality of vent channels defined through said body portion with said vent channels configured to pass said first material stream through said body portion, a plurality of feed channels defined through said body portion and configured to pass said second material stream through said body portion with said feed channels spaced from and in thermal communication with said vent channels such that at least one of said first and second material streams transfer heat with another one of said first and second material streams within said body portion. Each of said feed channels has a feed inlet for allowing said second material stream to enter said feed channels with said feed inlet having a cross-sectional area and with said cross-sectional area of said feed inlet of at least one of said feed channels different than said cross-sectional area of said feed inlet of another one of said feed channels for normalizing a flow rate of said second material stream through said feed channels of said body portion.

Other advantages of the present invention will be readily appreciated, as the same becomes better understood by reference to the following detailed description when considered in connection with the accompanying drawings wherein:

DETAILED DESCRIPTION

Figure 1:
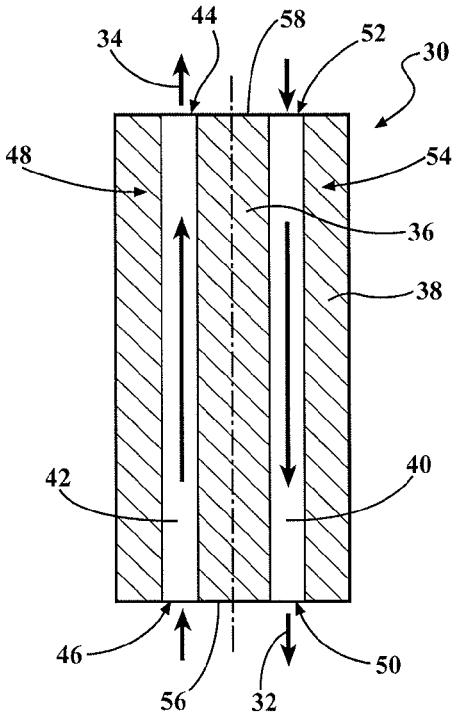
FIG. 1 is a schematic cross-sectional view of a heat exchanger.

Referring to the Figures, wherein like numerals indicate like or corresponding parts throughout the several views, a heat exchanger 30 is generally shown in cross-section in FIG. 1. The heat exchanger 30 is used to transfer heat between a first material stream 32 and a second material stream 34. More specifically, the first and second material streams 32, 34 each pass through the heat exchanger 30 simultaneously with the first and second material streams 32, 34 separated by a wall 36 to prevent mixing of the first and second material streams 32, 34. It is to be appreciated that the heat exchanger 30 may be of any suitable type of heat exchanger 30, such as a block heat exchanger, a plate heat exchanger, and a shell and tube heat exchanger. Additionally, the heat exchanger 30 may have any suitable configuration, such as rectangular, circular, oval and polygonal.

Typically, the first and second material streams 32, 34 enter the heat exchanger 30 at different temperatures. It is to be appreciated that the first material stream 32 and the second material stream 34 may be in any possible state of matter. However, typically the first material stream 32 and the second material stream 34 are in a liquid or gaseous state.

Heat is then transferred between the first and second material streams 32, 34 through the wall 36 of the heat exchanger 30. Generally, the heat exchanger 30 is used within a system where it is advantages to recapture heat from one material stream to heat another material stream. Recapturing the heat from one material stream improves an overall efficiency of the system because less energy has to be consumed to heat other material streams.

The first and second material streams 32, 34 have a velocity prior to entering the heat exchanger 30. Typically, the velocity of the first and second material streams 32, 34 is greater than 5, more typically of from about 5 to 30, and even more typically of from about 10 to 15 meters per second. Typically, at least one of the first and second material streams comprises a component selected from the group of one or more chlorosilane species, such as silicon tetrachloride, trichlorosilane, dichlorosilane, and monochlorosilane, hydrogen, nitrogen, hydrogen chloride, one or more polysilane containing species such as hexachlorodisilane; methane, and one or more carbon containing chlorosilane species such as methyltricholosilane or methyldichlorosilane.

The heat exchanger 30 includes a body portion 38 defining a plurality of vent channels 40 and a plurality of feed channels 42. More specifically, the plurality of vent channels 40 are defined through the body portion 38. Likewise, the plurality of feed channels 42 are defined through the body portion 38. Typically, the vent channels 40 and the feed channels 42 have a circular cross-section. However, it is to be appreciated that the vent channels 40 and/or the feed channels 42 may have other cross-sectional configuration, such as cuboidal.

The feed channels 42 are spaced from and in thermal communication with the vent channels 40. Generally, the wall 36 of the body portion 38 of the heat exchanger 30 separates the vent channels 40 and the feed channels 42. Typically, the vent channels 40 are configured to pass the first material stream 32 through the body portion 38 and the feed channels 42 are configured to pass the second material stream 34 through the body portion 38. Because of the proximity of the vent channels 40 and the feed channels 42 within the body portion 38, the first and second material stream 32, 34 transfer heat with each other. Said differently, heat can be transferred from at least one of the first material stream 32 and the second material stream 34 to the other one of the first material streams 32 and the second material stream 34 within said body portion 38 of the heat exchanger 30. For example, heat from the first material stream 32 can be transferred to the second material stream 34 for heating the second material stream 34. Alternatively, heat from the second material stream 34 can be transferred to the first material stream 32 for heating the first material stream. It is also to be appreciated the heating of one of the first and second material streams 32, 34 can alternate during the process such that the first material stream 32 is heated by the second material stream 34 and then, at a later time, the second material stream 34 may be heated by the first material stream 32.

Figure 2:
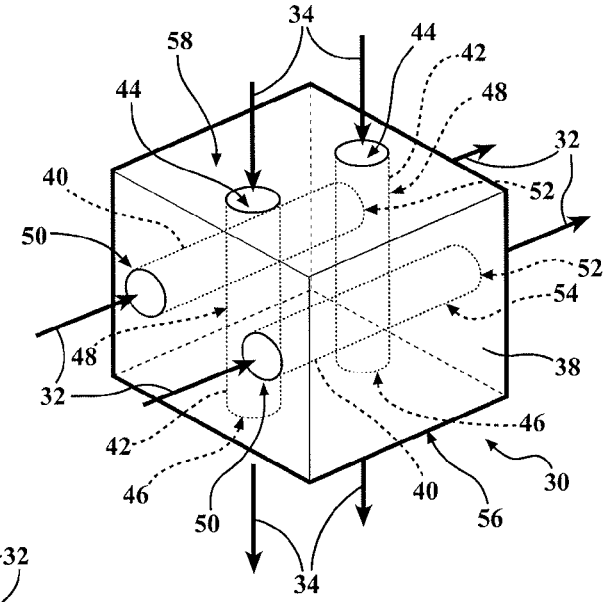
FIG. 2 is a schematic perspective view of the heat exchanger having a plurality of vent channels and a plurality of feed channels with the vent channels substantially perpendicular to the feed channels.
Figure 3:
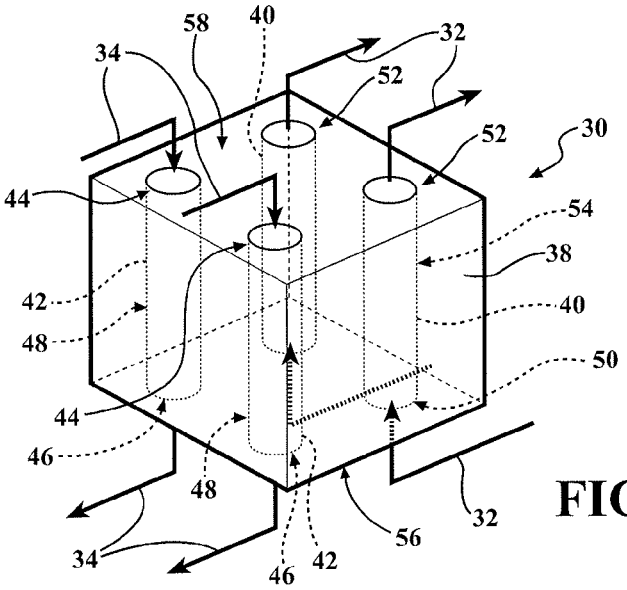
FIG. 3 is a schematic perspective view of the heat exchanger with the vent channels substantially parallel to the feed channels.
Figure 4:
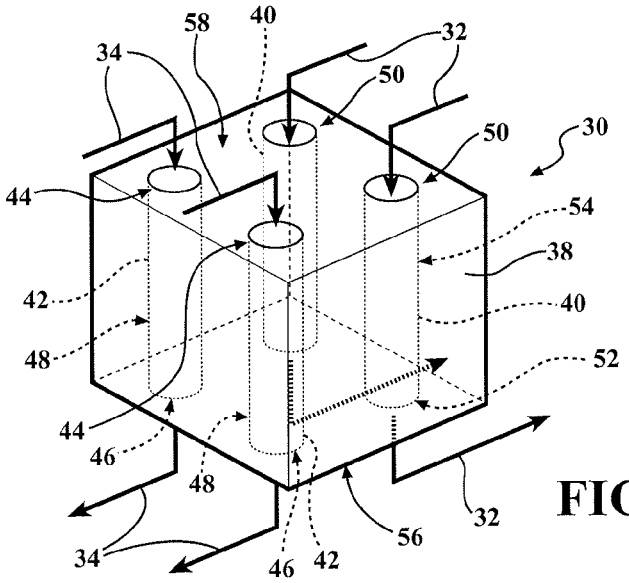
FIG. 4 is a schematic perspective view of the heat exchanger with the vent channels substantially parallel to the feed channels.

It is to be appreciated that the first and second material streams 32, 34 may flow through the body portion 38 of the heat exchanger 30 in any suitable manner to transfer heat. For example, a schematic representation of the heat exchanger 30 is shown in FIGS. 2-4 with each of FIGS. 2-4 showing a different relationship between the first material stream 32 and the second material stream 34. More specifically, FIG. 2 shows a schematic view of the heat exchanger 30 having a cross-flow relationship between the first material stream 32 and the second material stream 34 with the vent channels 40 and the feed channels 42 transverse to each other. FIG. 3 shows a schematic view of the heat exchanger 30 having a countercurrent flow relationship between the first material stream 32 and the second material stream 34 with the vent channels 40 and the feed channels 42 parallel with each other and with the flow of the first material stream 32 and the second material stream 34 in opposite directions. FIG. 4 shows a schematic view of the heat exchanger 30 having a parallel-flow relationship between the first material stream 32 and the second material stream 34 with the vent channels 40 and the feed channels 42 parallel with each other and the flow of the first material stream 32 and the second material stream 34 are in the same direction. It is to be appreciated the FIGS. 2-4 are intended to be illustrative examples of possible relationships between the first material stream 32 and the second material stream 34.

To aid in the heat exchange between the first material stream 32 and the second material stream 34, the body portion 38 comprises a thermally conductive material. Said differently, the body portion 38 is made from a material that allows, and even enhances, heat transfer between the first material stream 32 and the second material stream 34 within the body portion 38. Generally, the thermally conductive material of the body portion 38 is selected from the group of carbon, graphite, carbon fiber, ceramic, ceramic matrix composite, and metals, such as carbon steel, stainless steel, aluminum, copper, nickel, molybdenum, tungsten, tantalum, titanium, and their alloys. Additionally, the body portion 38, and more specifically the thermally conductive material of the body portion 38, may include a protective coating, for example a pyrolitic carbon or silicon carbide coating. The protective coating, when placed upon certain forms of carbon, graphite, carbon fiber, ceramic, or ceramic matrix composite material provides chemical protection from corrosive and, or high temperature chemicals such as chlorosilanes, hydrogen chloride, and others that are typically utilized in the chemical industry and polysilicon industry.

With reference to FIGS. 2-4, each of the feed channels 42 has a feed inlet 44 for allowing the second material stream 34 to enter the feed channels 42. Each of the feed channels 42 also has a feed outlet 46 opposite the feed inlet 44 for allowing the second material stream 34 to exit the vent channels 40. Each of the feed channels 42 has a main feed portion 48 between the feed inlet 44 and the feed outlet 46. Said differently, the feed channels 42 comprise three portions, the feed inlet 44, the main feed portion 48 and the feed outlet 46. The feed inlet 44, the main feed portion 48, and the feed outlet 46 are in communication with each other such that the second material stream 34 enters the body portion 38 of the heat exchanger 30 at the feed inlet 44, passes through the main feed portion 48, and exits the body portion 38 of the heat exchanger 30 at the feed outlet 46.

Similar to the feed channels 42 described above, each of the vent channels 40 has a vent inlet 50 for allowing the first material stream 32 to enter the vent channels 40. Each of the vent channels 40 also has a vent outlet 52 opposite the vent inlet 50 for allowing the first material stream 32 to exit the vent channels 40. Each of the vent channels 40 has a main vent portion 54 between the vent inlet 50 and the vent outlet 52. Said differently, the vent channels 40 comprise three portions, the vent inlet 50, the main vent portion 54, and the vent outlet 52. The vent inlet 50, the main vent portion 54, and the vent outlet 52 are in communication with each other such that the first material steam enters the body portion 38 of the heat exchanger 30 at the vent inlet 50, passes through the main vent portion 54, and exits the body portion 38 of the heat exchanger 30 at the vent outlet 52.

It is to be appreciated that the vent channels 40 and the feed channels 42 may be substantially parallel to each other within the body portion 38 of the heat exchanger 30, as shown in FIGS. 3 and 4. Alternatively, the vent channels 40 may be substantially transverse to one another within the body portion 38 of the heat exchanger 30, as shown in FIG. 2.

The body portion 38 includes a vent surface 56 and a feed surface 58 spaced from the vent surface 56. In one embodiment, the vent surface 56 defines the vent inlet 50 of each of the vent channels 40 and the feed surface 58 defines the feed inlet 44 of each of the feed channels 42. When the vent channels 40 and the feed channels 42 are substantially parallel to each other, the vent surface 56 is spaced from and opposite the feed surface 58, as shown in FIGS. 3 and 4. When the vent channels 40 and the feed channels 42 are substantially transverse to each other, the vent surface 56 is substantially transverse to the feed surface 58, as shown in FIG. 2.

Figure 5:
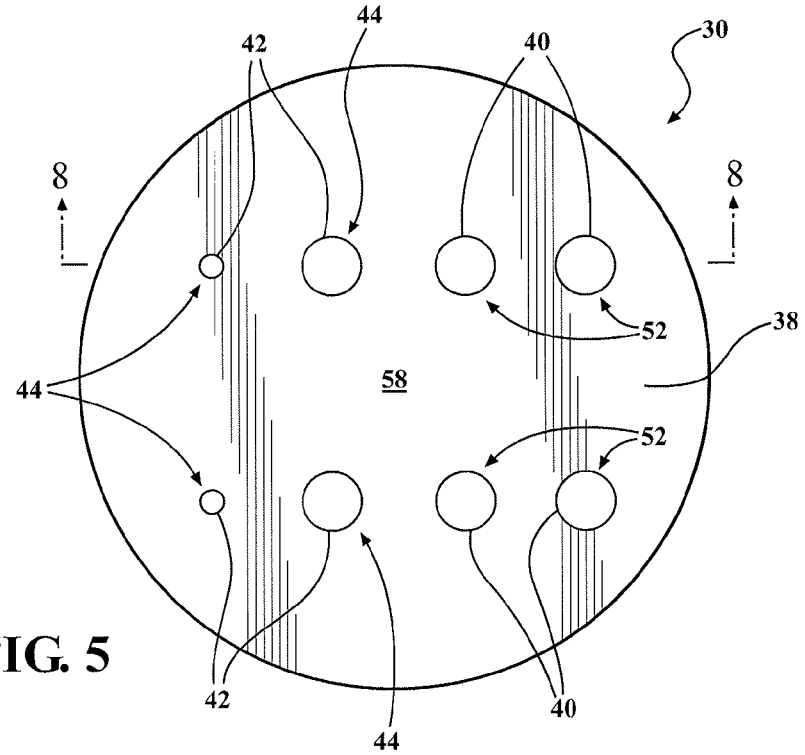
FIG. 5 is a schematic top view of a body portion of the heat exchanger.
Figure 6:
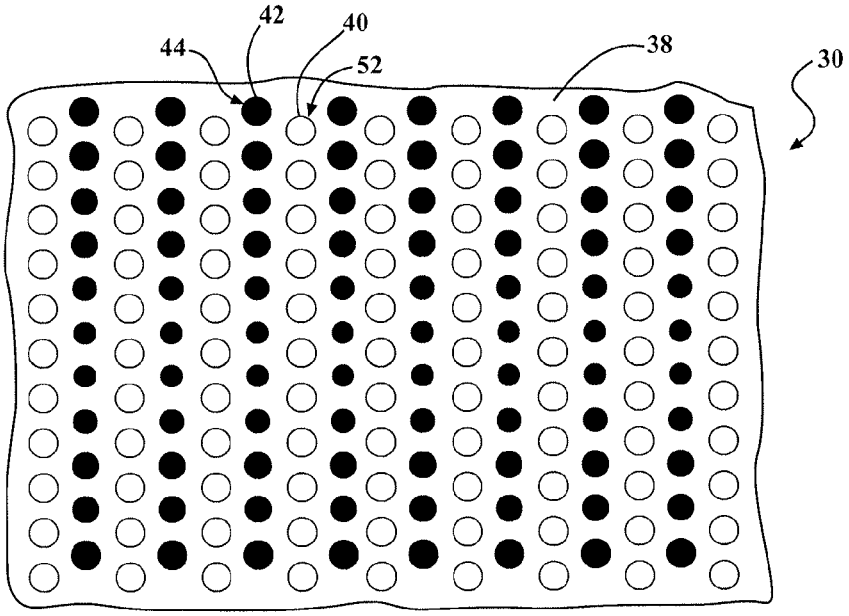
FIG. 6 is a top view of the body portion of the heat exchanger.
Figure 7:
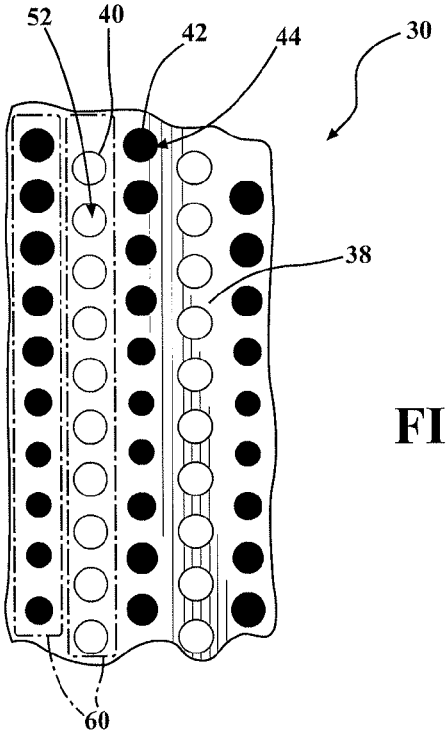
FIG. 7 is an enlarged top view of a portion of the heat exchanger of FIG. 6.
Figure 8:
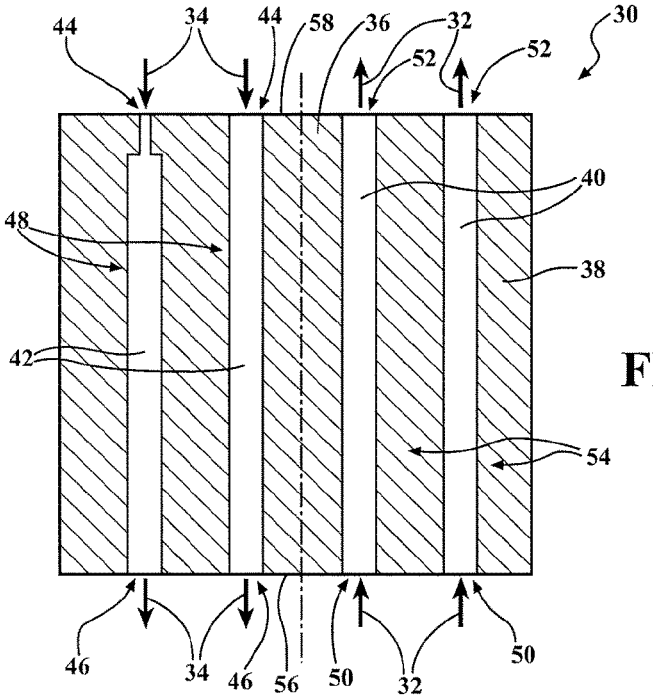
FIG. 8 is a schematic cross-sectional view of the heat exchanger taken along line 8-8 of FIG. 5.

With reference to FIGS. 5 and 8 showing the feed surface 58 of the body portion 38 of the heat exchanger 30, the feed inlets 44 are spaced from each other and, if present, are spaced from the vent outlets 52. The spacing of the feed inlets 44 and/or the vent outlets 52 presents a pattern on the feed surface 58. More specifically, the feed inlets 44 and the vent outlets 52 form the pattern. For simplicity of explanation, the pattern presented by the feed surface 58 are arranged in two rows with two of the feed inlets 44 and two of the vent outlets 52 per row. However, as shown in FIGS. 6 and 7, it is to be appreciated that the pattern may be complex with the feed inlets 44 and the vent outlets 52 arranged in an alternating pattern. It is to be appreciated that in FIGS. 6 and 7, the feed inlets 44 for the feed channels 42 have been filled in with a black fill for illustrative purposes only to easily differentiate between the feed inlets 44 and the vent outlets 52. It is to be appreciated that the pattern of the feed inlets 44 and the vent outlets 52 may be a linear pattern, a concentric pattern, and a radial pattern along the feed surface 58.

As described above, the feed channels 42 have three portions, the feed inlet 44, the main feed portion 48 and the feed outlet 46 and the vent channels 40 have three portions, the vent inlet 50, the main vent portion 54, and the vent outlet 52. Each portion of the vent channels 40 and the feed channels 42 has a cross-sectional area. More specifically, with reference to the vent channels 40, the vent inlet 50, the main vent portion 54, and the vent outlet 52 each have a cross-sectional area. Additionally, with reference to the feed channels 42, the feed inlet 44, the main feed portion 48, and the feed outlet 46 each have a cross-sectional area. It is to be appreciated that the cross-sectional area of different portions of the vent channels 40 and the feed channels 42 are based on an individual portion and is not a collective total of all of the portions of either the vent channels 40 or the feed channels 42. For example, the cross-sectional area of the vent inlet 50 is for an individual vent inlet 50 and is not the total cross-sectional area of all the vent inlets 50.

The first material steam and the second material stream 34 each have a flow rate. The flow rate of the first material stream 32 and the second material stream 34 is the velocity of the material streams through the vent channels 40 and the feed channels 42. The flow rate of the material streams through the vent channels 40 and the feed channels 42 is a function of a pressure differential at the feed inlet 44 for the feed channels 42 and the vent inlet 50 for the vent channels 40.

Without wishing to be bound by theory, it is believed that reducing the pressure differential between the feed inlets 44 will result in a normalized flow rate of the second material stream 34 through the fed channels. Said differently, it is believed that reducing the pressure differential between the feed inlets 44 will result in the flow rate of the second material stream 34 through each of the feed channels 42 to be uniform with each other. Normalizing the flow rate of the second material stream 34 through the feed channels 42 ensures that each of the feed channels 42 are being equally utilized to transfer the second material stream 34 through the body portion 38 of the heat exchanger 30. Said differently, normalizing the flow rate of the second material stream 34 through the feed channels 42 provides an even distribution of the second material stream 34 within the feed channels 42. Ensuring that each of the feed channels 42 are equally utilized increases an efficiency of the heat transfer between the first material stream 32 and the second material stream 34 because an active surface area of the heat exchanger 30 and a residence time of the second material stream 34 within the heat exchanger 30 are increased.

Generally, it has been determined that the flow rate of the second material stream 34 through an individual feed channel 42 can be accomplished by making it easier or harder for the second material stream 34 to enter the feed inlets 44 of the individual feed channel 42. Said differently, the pressure differential of an individual feed inlet 44 can be modified by varying the cross-sectional area of the individual feed inlet 44. In one embodiment, the feed inlets 44 are holes and the cross-sectional area of the selected feed inlet 44 is modified by changing a diameter of the hole. However, it is to be appreciated that the feed inlets 44 can be other configurations besides holes, such as slots, and the same principal modifying the cross-sectional area would still apply.

Generally, the cross-sectional area of the feed inlet 44 is reduced if the flow rate of the second material stream 34 through a corresponding feed channel 42 is higher than an average flow rate of the second material stream 34 through all of the feed channels 42. Conversely, the cross-sectional area of the feed inlet 44 is increased if the flow rate of the second material stream 34 through the corresponding feed channel 42 is less than the average flow rate of the second material stream 34 through all of the feed channels 42.

Typically, the cross-sectional area of the feed inlet 44 is reduced or increased by a ratio proportional to a difference between the flow rate of the second material stream 34 through the corresponding feed channel 42 and the average flow rate of the second material stream 34 through all of the feed channels 42.

The principal described above for normalizing the flow rate of the second material stream 34 through the feed channels 42 can be applied to the vent channels 40 to normalize the flow rate of the first material stream 32 through the vent channels 40. Additionally, the principals described above for normalizing the flow rate of the second material stream 34 through the feed channels 42 can be employed on any heat exchangers.

Typically, the cross-sectional area of the feed inlet 44 and/or the vent inlet 54 is below about 0.5, more typically between 0.008 to about 0.5, and more typically about 0.008 to about 0.2 square inches.

Figure 9:
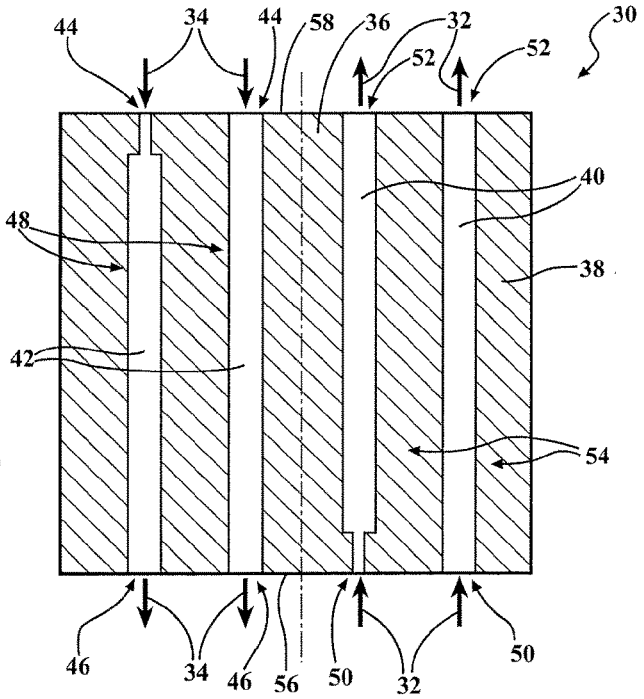
FIG. 9 is a schematic cross-sectional view of the heat exchanger showing at least one feed inlet of the feed channels having a different cross-sectional area relative to another feed inlet.

With reference to FIGS. 5 and 8 which show the schematic view of the heat exchanger 30, the cross-sectional area of the feed inlet 44 of at least one of the feed channels 42 is different than the cross-sectional area of the feed inlet 44 of another one of the feed channels 42 for normalizing the flow rate of the second material stream 34 through the feed channels 42. Said differently, the cross-sectional area of at least one of the feed inlets 44 is different than the cross-sectional area of the remaining feed inlets 44. With reference to FIG. 9, it is to be appreciated that the cross-sectional area of the vent inlet 50 of at least one of the vent channels 40 may be different than the cross-sectional area of the vent inlet 50 of another one of the vent channels 40 for normalizing the flow rate of the first material stream 32 through the vent channels 40. It is also to be appreciated that the cross-section area of any portion of the feed channels 42 and/or the vent channels 40 may be different for normalizing the flow rate of either the first or second material streams 32, 34.

Figure 10:
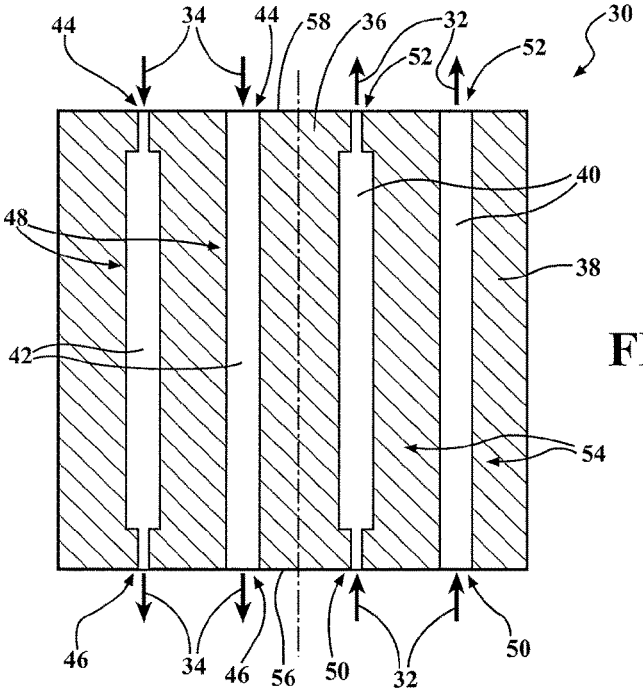
FIG. 10 is a schematic cross-sectional view of the heat exchanger showing at least one vent inlet of the vent channels having a different cross-sectional area relative to another vent inlet.

With reference to FIG. 10, the cross-sectional area of the feed outlet 46 of at least one of the feed channels 42 may be different than the cross-sectional area of the feed outlet 46 of another one of the feed channels 42. Said differently, the cross-sectional area of at least one of the feed outlets 46 is different than the remaining feed outlets 46. Similarly, the cross-sectional area of the vent outlet 52 of at least one of the vent channels 40 may be different than the cross-sectional area of the vent outlet 52 of another one of the vent channels 40.

Typically, the cross-sectional area of the feed inlets 44 is reduced to normalize the flow rate of the second material stream 34 through the feed channels 42. As such, the cross-sectional area of the main feed portion 48 of at least one of the feed channels 42 may be larger than the cross-sectional areas of the feed inlet 44 of the feed channels 42, as shown in FIGS. 9 and 10. Likewise, the cross-sectional area of the main vent portion 54 of at least one of the vent channels 40 may be larger than the cross-sectional area of the vent inlet 50 of the vent channels 40. It is believed that modifying the cross-sectional area of the main feed portion 48 of the feed channels 42 or the main vent portion 54 of the vent channels 40 can be done to normalize the flow rate of the second material stream 34 and the first material stream 32 through the feed channels 42 and the vent channels 40, respectively. In such an embodiment, the cross-sectional area of the main feed portion 48 or the main vent portion 54 can be larger or smaller than the cross-sectional area of the feed inlets 44 and the vent inlets 50, respectively. It is to be appreciated that the cross-sectional area of the main feed portion 48 of the feed channels 42 and the main vent portion 54 of the vent channels 40 may be uniform between the feed inlet 44 and the feed outlet 46 or between the vent inlet 50 and the vent outlet 52. The cross-sectional area of the main feed portion 48 and the main vent portion 54 is selected to produce a desired thermal communication between the first and second material streams 32, 34.

Figure 11:
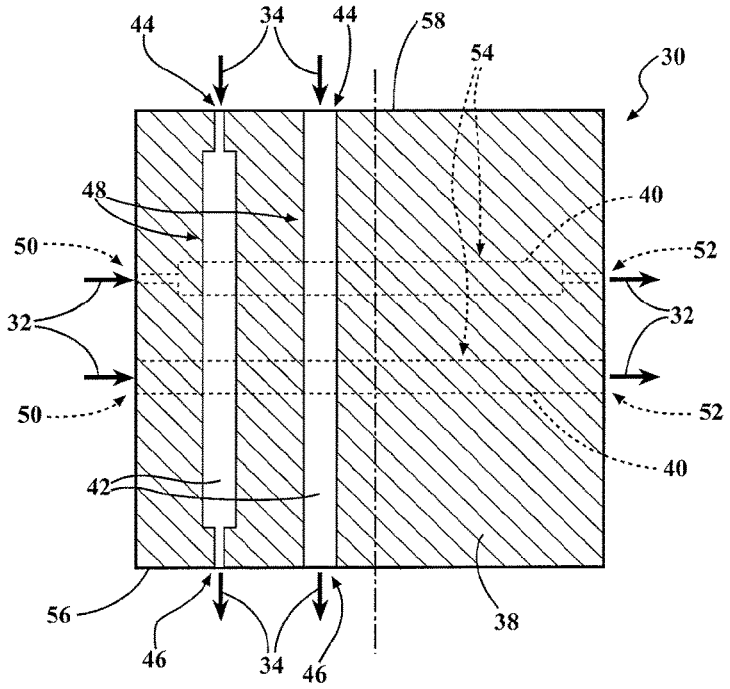
FIG. 11 is a schematic cross-sectional view of the heat exchanger with the vent channels and the feed channels substantially perpendicular to each other.

Although the vent channels 40 and the feed channels 42 are shown having the countercurrent flow relationship between the first material stream 32 and the second material stream 34 in FIGS. 8-10, it is to be appreciated that the vent channels 40 and the feed channels 42 may also have the cross-flow relationship, as shown in FIG. 11 or the parallel-flow relationship.

Figure 12:
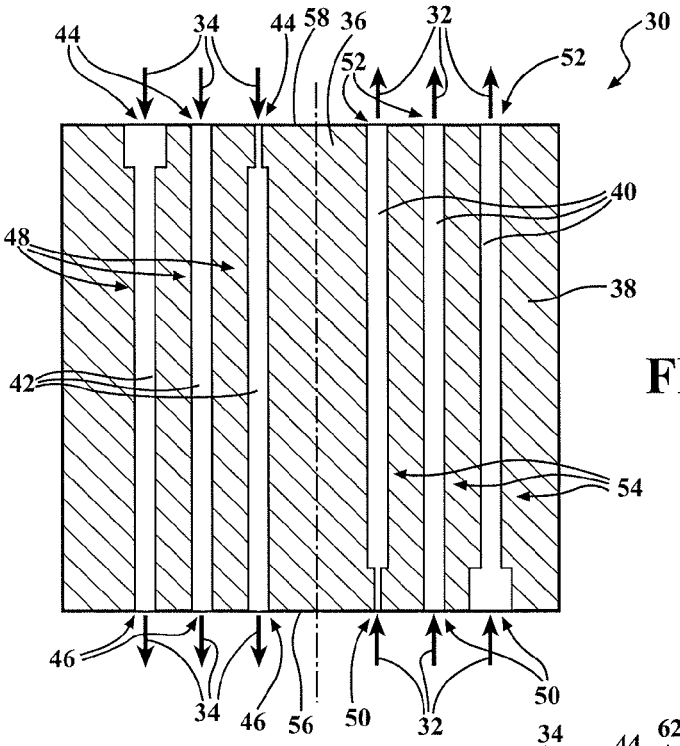
FIG. 12 is a schematic cross-sectional view of the heat exchanger having three feed inlets with the cross-sectional area of each of the feed inlets different than each other.

It is to be appreciated that the cross-sectional area of all of the feed inlets 44 may be different than each other. For example, as shown in FIG. 12, it is to be appreciated that the cross-sectional area of the feed inlet 44 of three different feed channels 42 may all be different than each other. In FIG. 12, the feed inlets 44 are shown with decreasing cross-sectional areas moving from left to right along the feed surface 58. Similarly, the cross-sectional area of the vent inlet 50 of three different vent channels 40 may all be different than each other.

As introduced above and as shown in FIGS. 5-7, the feed inlet 44 and the vent outlet 52 present the pattern on the feed surface 58 of the body portion 38 of the heat exchanger 30. With reference to FIGS. 6 and 7, a sequence 60 of feed inlets 44 and vent outlets 52 may be present within the pattern. The cross-sectional area of the feed inlet 44 and the vent outlets 52 may vary along the sequence 60, as best shown in FIG. 7. For example, the cross-sectional area of the feed inlets 44 along the sequence 60 deceases with each feed inlet 44 as the sequence 60 progresses toward a center of the feed surface 58. Then, the cross-sectional area of the feed inlets 44 begin to increase along the sequence 60 toward the center of the feed surface 58.

It is to be appreciated that the heat exchanger 30 may include a distributor block for accomplishing the principals described above for normalizing the flow rate of one or both of the first material stream 32 and the second material stream 34 through the vent channels 40 and the feed channels 42. Said differently, the distributor block can be employed to vary the cross-sectional area of one or both of the feed inlets 44 and the vent inlets 50 for normalizing the flow rate of one or both of the first material stream 32 and the second material stream 34 through the vent channels 40 and the feed channels 42. The distributor block is easier to manufacture and less expensive to manufacture with the feed inlets 44 having different cross-sectional areas than trying to manufacture the body portion 38 of the heat exchanger 30 with the feed inlets 44 having different cross-sectional areas.

The distributor block may also be utilized to allow a retrofit application for accomplishing the principals described above for normalizing the flow rate through the vent channels 40 and the feed channels 42. For example, the distributor block may be added to an existing heat exchanger 30 for accomplishing the principals described above for normalizing the flow rate through the vent channels 40 and the feed channels 42. This effect is especially true for specialized graphite block heat exchangers made from graphite materials and potentially coated with a chemically resistant layer. Such heat exchangers can be found in the corrosive chemicals industry, polysilicon production industry and others. Materials such as these are limited on size of production and therefore are not able to be scaled up to avoid flow distribution issues with higher flow rates.

Figure 13:
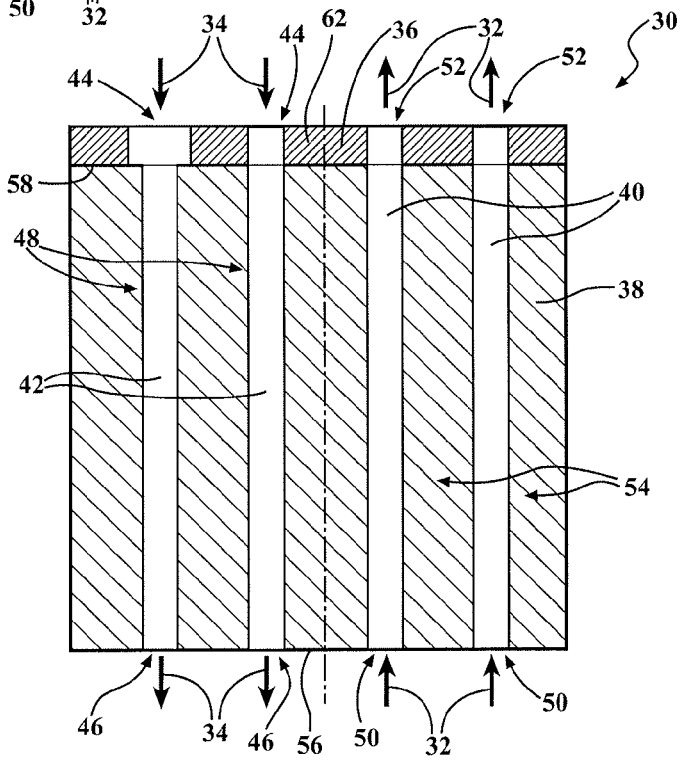
FIG. 13 is a schematic cross-sectional view of the heat exchanger including a feed distributor block.
Figure 14:
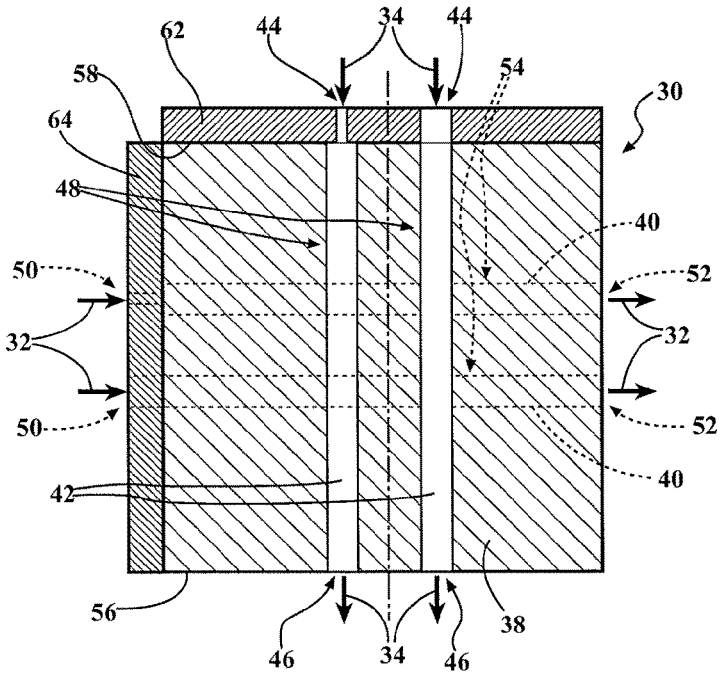
FIG. 14 is a schematic cross-sectional view of the heat exchanger including the feed distributor block and a vent distributor block.

As shown in FIG. 13, in one embodiment, the distributor block of the heat exchanger 30 may be further defined as a feed distributor block 62 with the feed distributor block 62 disposed adjacent the body portion 38. When present, the feed distributor block 62 defines the feed inlets 44 of each of the feed channels 42. In such an embodiment, the feed inlets 44 defined by the feed distributor block 62 are aligned with the main feed portion 48 of the feed channels 42 within the body portion 38. It is to be appreciated that the vent outlets 52 of the vent channels 40 may be defined by the feed distributor block 62 as shown in FIG. 13. Alternatively, when the feed distributor block 62 is employed, the vent outlets 52 may be defined by the body portion 38 of the heat exchanger 30, as shown in FIG. 14. It is to be appreciated that when the feed distributor block 62 defines the feed inlet 44 and the vent outlet 52, the feed distributor block 62 presents the pattern of the feed inlets 44 and the vent outlets 52.

Figure 15:
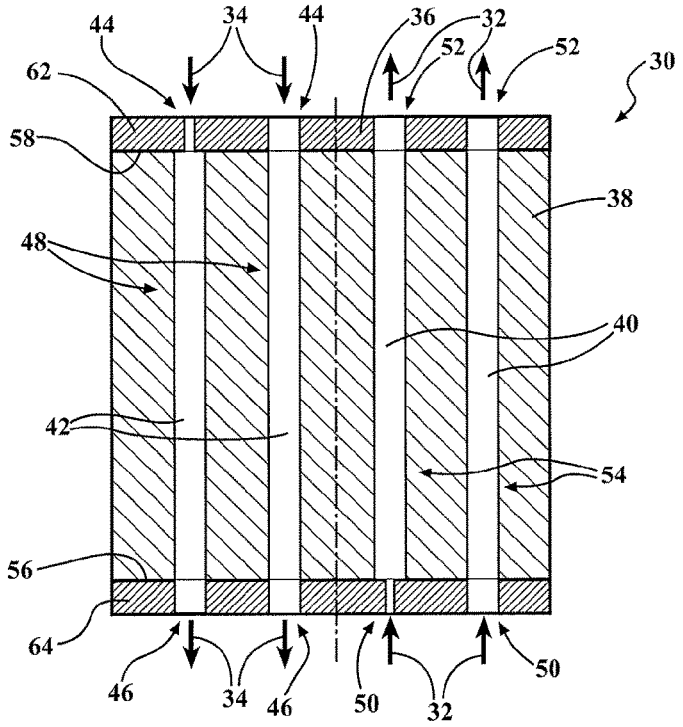
FIG. 15 is a schematic cross-sectional view of the heat exchanger including the feed distributor block and a vent distributor block.

With reference to FIGS. 14 and 15, in another embodiment the heat exchanger 30 may further include a vent distributor block 64 defining the vent inlet 50 of each of the vent channels 40. In such an embodiment, the vent inlets 50 defined by the vent distributor block 64 are aligned with the main vent portion 54 of the vent channels 40 within the body portion 38. When the vent distributor block 64 is present, the feed outlets 46 may be defined by the body portion 38 of the heat exchanger 30, as shown in FIG. 14, or the feed outlets 46 may be defined by the vent distributor block 64, as shown in FIG. 15.

It is to be appreciated that the body portion 38 of the heat exchanger 30 and/or the distributor block may be formed from multiple components, such that at least two sections are joined together to form the body portion 38 and/or the distributor block.

Figure 16:
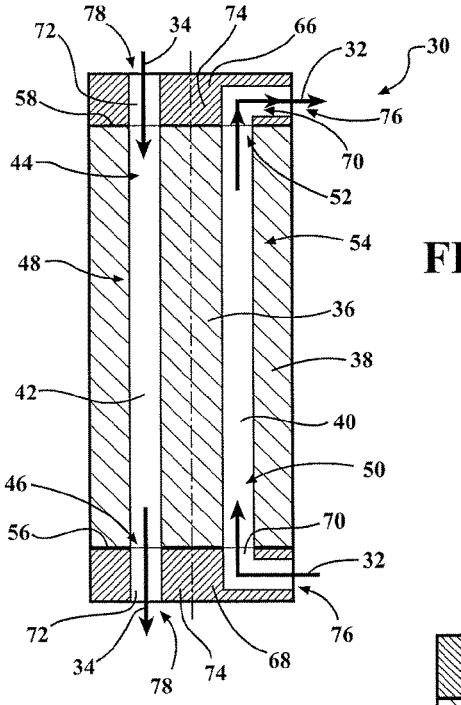
FIG. 16 is a schematic cross-sectional view of the heat exchanger including a feed transition block and a vent transition block.

As introduced above, the first and second material streams 32, 34 are separated by the wall 36 to prevent mixing of the first and second material streams 32, 34. As such, with reference to FIGS. 16-18, the heat exchanger 30 may include a feed transition block 66 disposed adjacent the feed surface 58 and a vent transition block 68 adjacent the vent surface 56 of the body portion 38. It is to be appreciated that the feed transition block 66 and the vent transition block 68 are schematically shown in FIG. 16. The feed transition block 66 and the vent transition block 68 direct the first and second material streams 32, 34 in different directions to keep the first and second material streams 32, 34 separate from each other before entering the heat exchanger 30 or upon exiting the heat exchanger 32.

The feed transition block 66 and the vent transition block 68 each have a first pathway 70 and a second pathway 72 separated by a dividing wall 74. As shown in FIG. 16, the first material stream 32 flows through the first pathway 70 of the feed transition block 66 and out port 76. The second material stream 34 flows enters the second pathway 72 of the feed transition block 66 at port 78. The ports 76, 78 are separate from each other to maintain separation of the first material stream 32 and the second material stream 34. With reference to the vent transition block 68 of FIG. 16, the first material stream 32 enters the first pathway 70 of the vent transition block 68 at the vent port 76 and the second material stream 34 flows through the second pathway 72 and out the feed port 78.

Figure 17:
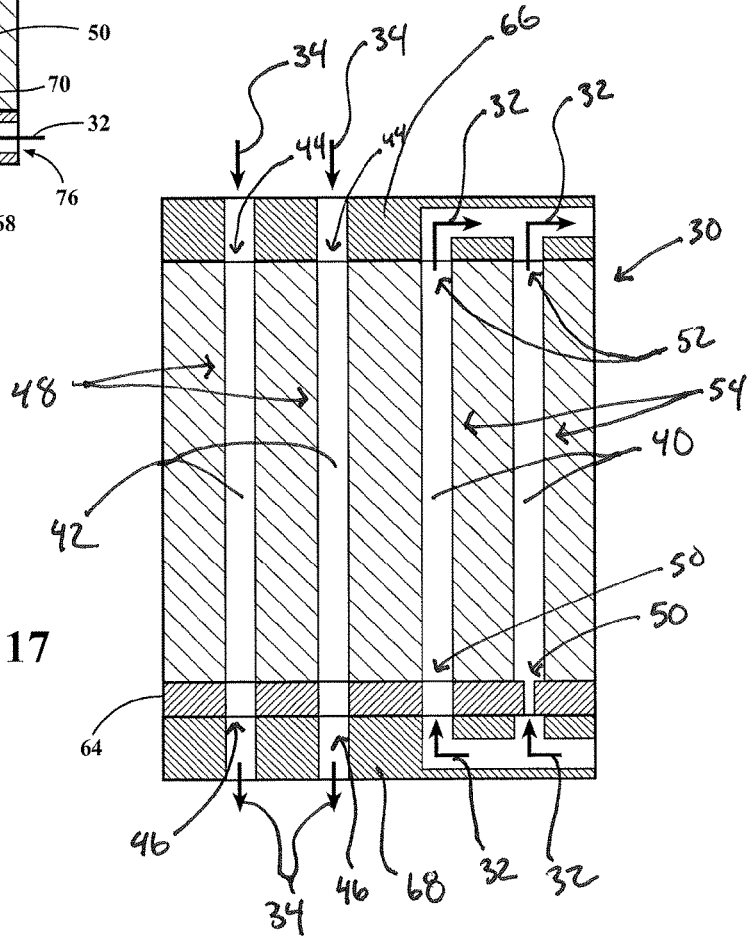
FIG. 17 is a schematic cross-sectional view of the heat exchanger including a feed transition block and a vent transition block.
Figure 18:
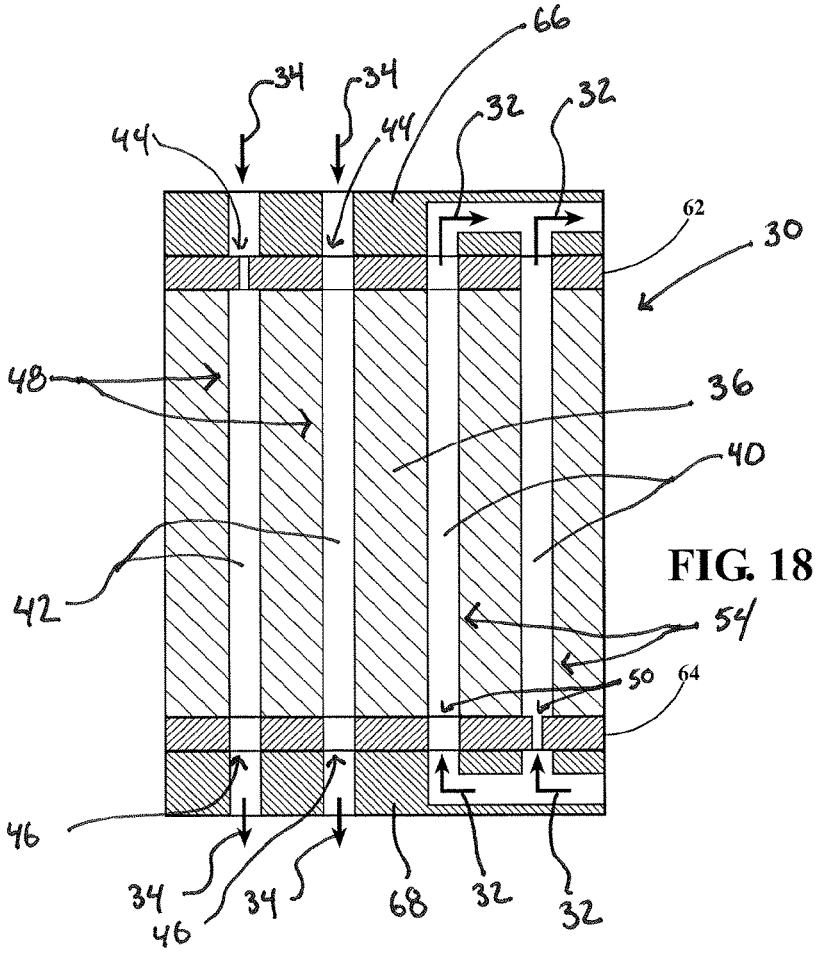
FIG. 18 is a schematic cross-sectional view of the heat exchanger including a feed transition block and a vent transition block.

It is to be appreciated that additional embodiments of the heat exchanger 30 having the feed transition block 66 and the vent transition block 68 are schematically shown in FIGS. 17 and 18. When present, the vent distributor block 64 is disposed between the vent transition block 68 and the body portion 38 of the heat exchanger 30. It is also possible to place the feed distributor block 62 between the feed transition block 66 and the body portion 38 of the heat exchanger 30. It is to be appreciated that the vent distributor 64 and feed distributor 62 can be utilized independently or simultaneously. It is to be appreciated that the heat exchanger 30 may include any number of feed transition blocks 66 or vent transition blocks 68.

Figure 19:
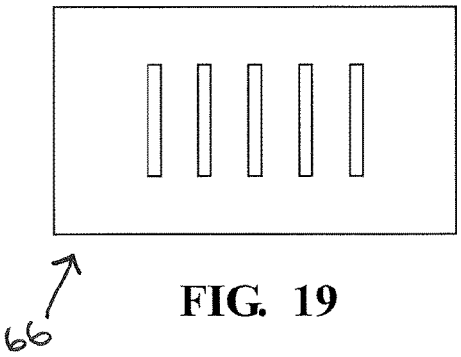
FIG. 19 is a plan view of the feed transition block.
Figure 20:
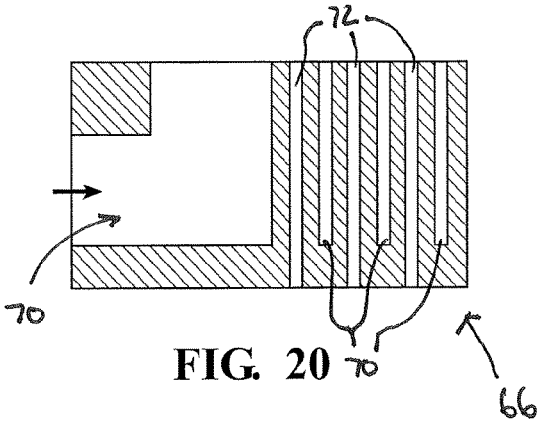
FIG. 20 is a cross-sectional view of the feed transition block of FIG. 19.

With reference to FIGS. 6 and 7, the pattern of the feed inlets 44 and the vent outlets 52 may be such that the feed inlets 44 and the vent outlets 52 are mixed together at the feed surface 58 of the body portion 38 of the heat exchanger 30. To prevent mixing of the first material stream 32 and the second material stream 34, the feed transition block 66 and the vent transition block 68 may include multiple first pathways 70 and multiple second pathways 72, as shown in FIGS. 19 and 20. Additionally, either or both of the feed or vent transition blocks 66 or 68 may also act as distributor blocks. Alternatively, a second feed distributor block or vent distributor block is added to the entrance of the feed and/or vent transition blocks to provide a series of feed and/or transition distributor blocks. This cascading use of distribution blocks may be performed multiple times to affect improved distribution. The additional feed or vent distributor blocks also include multiple pathways that route the first material stream 32 and/or the second material stream 34 to the feed and vent transition blocks. It is to be appreciated that at least one of the pathways of the additional feed or vent distributor blocks has a cross-sectional area that is different than at least one other pathway. In this manner, a cascading distribution of the first material stream 32 and the second material stream 34 is achieved.

Figure 21:
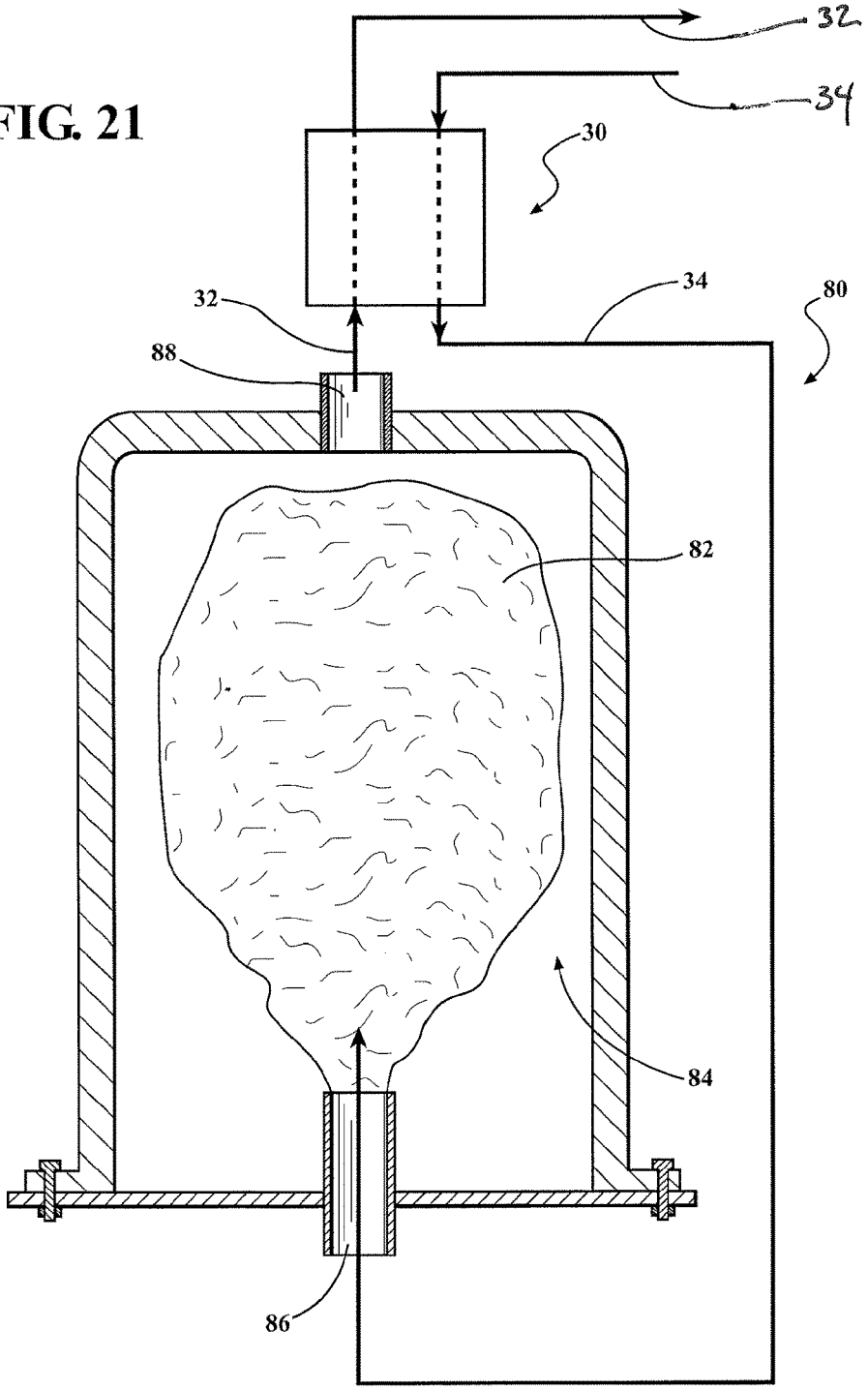
FIG. 21 is a schematic view of a reactor system including the heat exchanger.

With reference to FIG. 21, in one embodiment, the heat exchanger 30 is used in a reactor system 80 for processing a feed gas 82. For example, the heat exchanger 30 may be used in the reactor system 80 for hydrogenating silicon tetrachloride. However, it is to be appreciated that the heat exchanger 30 can be used in any system where it is desired to exchange heat between two or more material streams.

The reactor system 80 includes a reaction chamber 84 having an entrance port 86 for introducing the second material stream 34 into the reaction chamber 84. Typically, the second material stream 34 comprises the feed gas 82. The reaction chamber 84 also defines an exhaust port 88 for exhausting the first material stream 32, which comprises the feed gas 82 and/or a product and/or a byproduct of the reaction within the reaction chamber 84, from the reaction chamber 84. Typically, the first material stream 32 passes through the exhaust port 88 after processing of the feed gas 82 occurs.

In the embodiment where the reaction chamber 84 is present, the feed outlets 46 of the feed channels 42 are in communication with the entrance port 86 of the reaction chamber 84 such that the second material stream 34 passes through the heat exchanger 30 prior to entering the reaction chamber 84. Additionally, the vent inlets 50 of the vent channels 40 are in communication with the exhaust port 88 of the reaction chamber 84 such that the first material passes through the heat exchanger 30 after being exhausted from the reaction chamber 84. Typically, the feed gas 82 is heated within the reaction chamber 84. Therefore, the first material stream 32 exiting the reaction chamber 84 is hotter than the second material stream 34 entering the reaction chamber 84. In this embodiment, the first material stream 32 transfers heat to the second material stream 34 for heating the second material stream 34 prior to the second material stream 34 entering the reaction chamber 84. Said differently, the hotter first material stream 32 that exited the reaction chamber 84 heats the second material stream 34 within the heat exchanger 30, and therefore heats the feed gas 82, for reducing the energy required to heat the feed gas 82 within the reaction chamber 84.

These examples are intended to illustrate some embodiments of the invention and should not be interpreted as limiting the scope of the invention set forth in the claims. Reference examples should not be deemed to be prior art unless so indicated.

Figure 22:
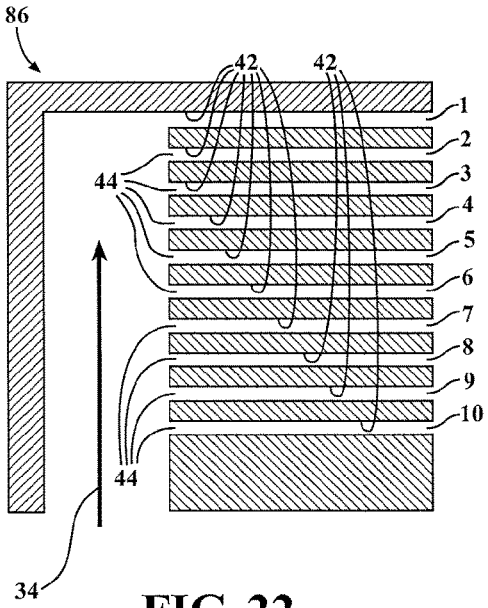
FIG. 22 is a schematic view of a first testing heat exchanger.

A first computational fluid dynamic simulation is performed on a first testing heat exchanger 86 and a second testing heat exchanger 88. Both the first and second testing heat exchangers 86, 88 have the cross-flow flow relationship between the first material stream 32 and the second material stream 34. The first testing heat exchanger 86 does not include the distributor block. The feed inlets 44 of the first testing heat exchanger 86 each have a diameter of 0.40 inches. A schematic representation of the first testing heat exchanger 86 is shown in FIG. 22.

Figure 23:
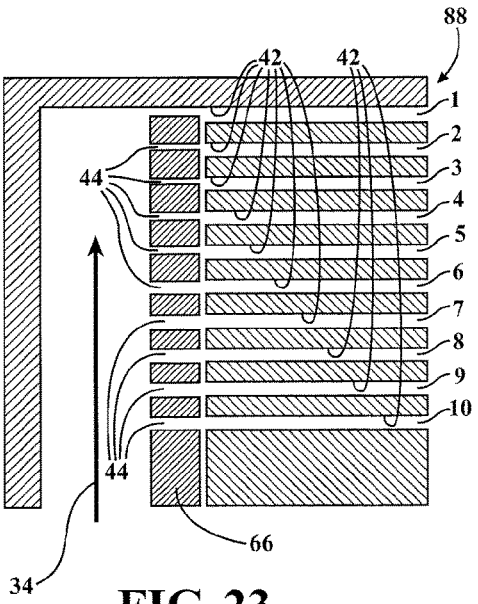
FIG. 23 is a schematic view of a second testing heat exchanger.

The second testing heat exchanger 88 includes the feed distributor block 66 defining the feed inlets 44. The diameters of the feed inlets 44 of the second testing heat exchanger 88 had diameters that varied between 0.24 and 0.40 inches. A schematic representation of the second testing heat exchanger 88 is shown in FIG. 23.

A feed velocity into the first and second testing heat exchangers 86, 88 was ten meters per second with a density of ten kilograms per cubic meter and viscosity of 1.75E-5 Pa-s. Table 1 below lists the diameters of the feed inlets 44 and the resulting flow rate through the feed channels 42 of the first and second testing heat exchangers 86, 88.

TABLE 1

| | First testing heat exchanger 86 | | Second testing heat exchanger 88 | |
|---|---|---|---|---|
| Hole # | Dia. Of Feed inlet 44 | Resulting Flow Rate | Dia. Of Feed inlet 44 | Resulting Flow Rate |
| 1 | 0.40 inch | 1.97 lb/s | 0.24 inch | 1.55 lb/s |
| 2 | 0.40 inch | 2.01 lb/s | 0.26 inch | 1.50 lb/s |
| 3 | 0.40 inch | 1.98 lb/s | 0.28 inch | 1.63 lb/s |
| 4 | 0.40 inch | 1.93 lb/s | 0.30 inch | 1.73 lb/s |
| 5 | 0.40 inch | 1.85 lb/s | 0.31 inch | 1.79 lb/s |
| 6 | 0.40 inch | 1.75 lb/s | 0.33 inch | 1.82 lb/s |
| 7 | 0.40 inch | 1.61 lb/s | 0.35 inch | 1.82 lb/s |
| 8 | 0.40 inch | 1.45 lb/s | 0.37 inch | 1.78 lb/s |
| 9 | 0.40 inch | 1.26 lb/s | 0.38 inch | 1.69 lb/s |
| 10 | 0.40 inch | 1.01 lb/s | 0.40 inch | 1.50 lb/s |

The average resulting flow rate through the feed channels 42 of the first testing heat exchanger 86 is 1.68 lb/s. The maximum flow rate through the feed channels 42 of the first testing heat exchanger 86 is 20% higher than the average resulting flow rate for the first testing heat exchanger 86. The minimum flow rate through the feed channels 42 of the first testing heat exchanger 86 is 40% lower than the average resulting flow rate for the first testing heat exchanger 86. Additionally, the maximum flow rate through the feed channels 42 of the first testing heat exchanger 86 is 99% higher than the minimum flow rate through the feed channels 42 of the first testing heat exchanger 86.

The average resulting flow rate through the feed channels 42 of the second testing heat exchanger 88 is 1.68 lb/s. The maximum flow rate through the feed channels 42 of the second testing heat exchanger 88 is 8% higher than the average resulting flow rate for the second testing heat exchanger 88. The minimum flow rate through the feed channels 42 of the second testing heat exchanger 88 is 11% lower than the average resulting flow rate for the second testing heat exchanger 88. Additionally, the maximum flow rate through the feed channels 42 of the second testing heat exchanger 88 is 21% higher than the minimum flow rate through the feed channels 42 of the second testing heat exchanger 88.

Therefore, because the difference between the maximum and minimum flow rate relative to the average flow rate of the second testing heat exchanger 88 was not as great as the difference between the maximum and minimum flow rates relative to the average flow rate of the first testing heat exchanger 86, it can be concluded the second testing heating exchanger 88 has a more evenly distributed flow rate within the feed channels 42 as compared to the flow rate of the feed channels 42 of the first testing heat exchanger 86.

Figure 24:
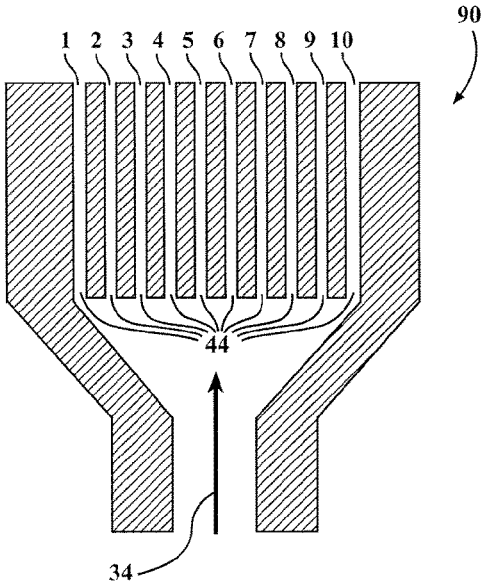
FIG. 24 is a schematic view of a third testing heat exchanger.

A second computational fluid dynamic simulation is performed on a third testing heat exchanger 90 and a fourth testing heat exchanger 92. Both the third and fourth testing heat exchanger 90, 92 have the countercurrent flow relationship between the first material stream 32 and the second material stream 34. The third testing heat exchanger 90 does not include the distributor block. The feed inlets 44 of the third testing heat exchanger 90 each had a diameter of 0.40 inches. A schematic representation of the third testing heat exchanger 90 is shown in FIG. 24.

Figure 25:
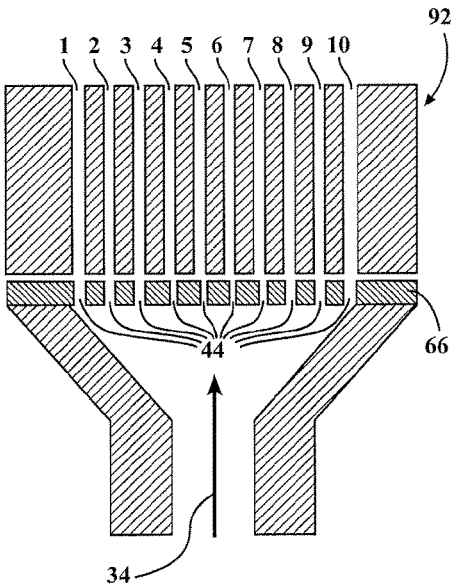
FIG. 25 is a schematic view of a fourth testing heat exchanger.

The fourth testing heat exchanger 92 includes the feed distributor block 66 defining the feed inlets 44. The diameters of the feed inlets 44 of the fourth testing heat exchanger 92 had diameters that varied between 0.23 and 0.40 inches. A schematic representation of the fourth testing heat exchanger 92 is shown in FIG. 25.

A feed velocity into the third and fourth testing heat exchanger 90, 92 was ten meters per second with a density of ten kilograms per cubic meter and viscosity of 1.75E-5 Pa-s. Table 2 below lists the diameters of the feed inlets 44 and the resulting flow rate through the feed channels 42 for the third and fourth testing heating exchangers 90, 92.

TABLE 2

| | Third testing heat exchanger 90 | | Fourth testing heat exchanger 92 | |
|---|---|---|---|---|
| Hole # | Dia. Of Feed inlet 44 | Resulting Flow Rate | Dia. Of Feed inlet 44 | Resulting Flow Rate |
| 1 | 0.40 inch | 1.27 lb/s | 0.40 inch | 1.75 lb/s |
| 2 | 0.40 inch | 1.17 lb/s | 0.36 inch | 1.58 lb/s |
| 3 | 0.40 inch | 1.65 lb/s | 0.31 inch | 1.62 lb/s |
| 4 | 0.40 inch | 2.08 lb/s | 0.27 inch | 1.74 lb/s |
| 5 | 0.40 inch | 2.23 lb/s | 0.23 inch | 1.71 lb/s |
| 6 | 0.40 inch | 2.23 lb/s | 0.23 inch | 1.71 lb/s |
| 7 | 0.40 inch | 2.08 lb/s | 0.27 inch | 1.74 lb/s |
| 8 | 0.40 inch | 1.65 lb/s | 0.31 inch | 1.62 lb/s |
| 9 | 0.40 inch | 1.17 lb/s | 0.36 inch | 1.58 lb/s |
| 10 | 0.40 inch | 1.27 lb/s | 0.40 inch | 1.75 lb/s |

The average resulting flow rate through the feed channels 42 of the third testing heat exchanger 90 is 1.68 lb/s. The maximum flow rate through the feed channels 42 of the third testing heat exchanger 90 is 33% higher than the average resulting flow rate for the third testing heat exchanger 90. The minimum flow rate through the feed channels 42 of the third testing heat exchanger 90 is 33% lower than the average resulting flow rate for the third testing heat exchanger 90. Additionally, the maximum flow rate through the feed channels 42 of the third testing heat exchanger 90 is 90% higher than the minimum flow rate through the feed channels 42 of the third testing heat exchanger 90.

The average resulting flow rate through the feed channels 42 of the fourth testing heat exchanger 92 is 1.68 lb/s. The maximum flow rate through the feed channels 42 of the fourth testing heat exchanger 92 is 4% higher than the average resulting flow rate for the fourth testing heat exchanger 92. The minimum flow rate through the feed channels 42 of the fourth testing heat exchanger 92 is 6% lower than the average resulting flow rate for the fourth testing heat exchanger 92. Additionally, the maximum flow rate through the feed channels 42 of the fourth testing heat exchanger 92 is 11% higher than the minimum flow rate through the feed channels 42 of the fourth testing heat exchanger 92.

Therefore, because the difference between the maximum and minimum flow rate relative to the average flow rate of the fourth testing heat exchanger 92 was not as great as the difference between the maximum and minimum flow rates relative to the average flow rate of the third testing heat exchanger 90, it can be concluded the fourth testing heating exchanger 92 has a more evenly distributed flow rate within the feed channels 42 as compared to the flow rate of the feed channels 42 of the third testing heat exchanger 90.

The heat exchanger and reactor system disclosed herein include at least the following embodiments:

Embodiment 1

A heat exchanger for transferring heat between first and second material streams, said heat exchanger comprising: a body portion comprising a thermally conductive material, said body portion comprising; a plurality of vent channels defined through said body portion with said vent channels configured to pass the first material stream through said body portion, a plurality of feed channels defined through said body portion and configured to pass the second material stream through said body portion with said feed channels spaced from and in thermal communication with said vent channels such that at least one of the first and second material streams transfer heat with another one of the first and second material streams within said body portion, wherein each of said feed channels has a feed inlet for allowing the second material stream to enter said feed channels with said feed inlet having a cross-sectional area and with said cross-sectional area of said feed inlet of at least one of said feed channels different than said cross-sectional area of said feed inlet of another one of said feed channels for normalizing a flow rate of the second material stream through said feed channels of said body portion.

Embodiment 2

A heat exchanger as set forth in embodiment 1, wherein each of said feed channels have a feed outlet opposite said feed inlet of said feed channels for allowing the second material stream to exit the feed channels with said feed outlet of each of said feed channels having a cross-sectional area and with said cross-sectional area of said feed outlet of at least one of said feed channels different than said cross-sectional area of said feed outlet of another one of said feed channels.

Embodiment 3

A heat exchanger as set forth in embodiment 2 wherein said feed channels have a main feed portion between said feed inlet and said feed outlet of said feed channels with said main feed portion of said feed channels having a cross-sectional area and with said cross-sectional area of said main feed portion of at least one of said feed channels larger than said cross-sectional areas of said feed inlet of said feed channels.

Embodiment 4

A heat exchanger as set forth in any of embodiments 1 to 3, wherein each of said vent channels have a vent inlet for allowing the first material stream to enter said vent channels with said vent inlet of said vent channels having a cross-sectional area and with said cross-sectional area of a said vent inlet of at least one of said vent channels different than said cross-sectional area of said vent inlet of another one of said vent channels for normalizing a flow rate of the first material stream through said vent channels of said body portion.

Embodiment 5

A heat exchanger as set forth in embodiment 4, wherein each of said vent channels have a vent outlet opposite said vent inlet of said vent channels for allowing the first material stream to exit the vent channels with said vent outlet of each of said vent channels having a cross-sectional area and with said cross-sectional area of said vent outlet of at least one of said vent channels different than said cross-sectional area of said vent outlet of another one of said vent channels.

Embodiment 6

A heat exchanger as set forth in embodiment 5, wherein said vent channels have a main vent portion between said vent inlet and said vent outlet of said vent channels with said main vent portion of said vent channels having a cross-sectional area and with said cross-sectional area of said main vent portion of at least one of said vent channels larger than said cross-sectional area of said vent inlet of another one of said vent channels.

Embodiment 7

A heat exchanger as set forth in embodiment 4, wherein said body portion includes a feed surface defining said feed inlet of said feed channels and said body portion includes a vent surface opposite said feed surface with said vent surface defining said vent inlet of said vent channels and with said feed channels substantially parallel with said vent channels within said body portion.

Embodiment 8

A heat exchanger as set forth in embodiment 4, wherein said body portion includes a feed surface defining said feed inlet of said feed channels and said body portion includes a vent surface substantially transverse to said feed surface with said vent surface defining said vent inlet of said vent channels and with said feed channels substantially transverse with said vent channels within said body portion.

Embodiment 9

A heat exchanger as set forth in any of embodiments 1 to 8, further including at least one feed distributor block disposed in series and adjacent said body portion and defining said feed inlet of said feed channels.

Embodiment 10

A heat exchanger as set forth in embodiment 9, further including at least one vent distributor block disposed in series and adjacent said body portion opposite said feed distributor block with said vent distributor block defining said vent inlet of said vent channels.

Embodiment 11

A heat exchanger as set forth in any of embodiments 1 to 10, wherein said feed inlet of each of said feed channels are spaced from each other linearly, concentrically, and/or radially along said body portion.

Embodiment 12

A heat exchanger as set forth in any of embodiments 1 to 11, wherein said cross-sectional area of said feed inlet of said one of said feed channels is reduced proportionally to a difference between an average flow rate of the second material stream through said feed channels and an actual flow rate through said one of said feed channels.

Embodiment 13

A heat exchanger as set forth in any of embodiments 1 to 12, wherein said thermally conductive material of said body portion is selected from the group of carbon, graphite, carbon fiber, ceramic, ceramic matrix composite, and metals.

Embodiment 14

A heat exchanger as set forth in any of the preceding embodiments, wherein the cross-sectional area of said feed inlet is below about 0.5 square inches.

Embodiment 15

A reactor system for processing a feed gas, said reactor system comprising: a reaction chamber having an entrance port for introducing a second material stream comprising the feed gas into said reaction chamber and an exhaust port for exhausting a first material stream from the reaction chamber after processing of the feed gas of the second material stream, a heat exchanger having a body portion comprising a thermally conductive material, said body portion comprising; a plurality of vent channels defined through said body portion with said vent channels configured to pass said first material stream through said body portion, a plurality of feed channels defined through said body portion and configured to pass said second material stream through said body portion with said feed channels spaced from and in thermal communication with said vent channels such that at least one of said first and second material streams transfer heat with another one of said first and second material streams within said body portion, wherein each of said feed channels has a feed inlet for allowing said second material stream to enter said feed channels with said feed inlet having a cross-sectional area and with said cross-sectional area of said feed inlet of at least one of said feed channels different than said cross-sectional area of said feed inlet of another one of said feed channels for normalizing a flow rate of said second material stream through said feed channels of said body portion.

The singular forms "a," "an," and "the" include plural referents unless the context clearly dictates otherwise. "Or" means "and/or." The modifier "about" used in connection with a quantity is inclusive of the stated value and has the meaning dictated by the context (e.g., includes the degree of error associated with measurement of the particular quantity). The notation "+10%" means that the indicated measurement can be from an amount that is minus 10% to an amount that is plus 10% of the stated value. The endpoints of all ranges directed to the same component or property are inclusive and independently combinable (e.g., ranges of "less than or equal to 25 wt %, or 5 wt % to 20 wt %," is inclusive of the endpoints and all intermediate values of the ranges of "5 wt % to 25 wt %," etc.). Disclosure of a narrower range or more specific group in addition to a broader range is not a disclaimer of the broader range or larger group.

The suffix "(s)" is intended to include both the singular and the plural of the term that it modifies, thereby including at least one of that term (e.g., the colorant(s) includes at least one colorants). "Optional" or "optionally" means that the subsequently described event or circumstance can or cannot occur, and that the description includes instances where the event occurs and instances where it does not. Unless defined otherwise, technical and scientific terms used herein have the same meaning as is commonly understood by one of skill in the art to which this invention belongs. A "combination" is inclusive of blends, mixtures, alloys, reaction products, and the like.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

While typical embodiments have been set forth for the purpose of illustration, the foregoing descriptions should not be deemed to be a limitation on the scope herein. Accordingly, various modifications, adaptations, and alternatives can occur to one skilled in the art without departing from the spirit and scope herein.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A heat exchanger for transferring heat between first and second material streams, said heat exchanger comprising: a body portion comprising a thermally conductive material, said body portion comprising; a plurality of vent channels defined through said body portion with said vent channels configured to pass the first material stream through said body portion, a plurality of feed channels defined through said body portion and configured to pass the second material stream through said body portion with said feed channels spaced from and in thermal communication with said vent channels such that at least one of the first and second material streams transfer heat with another one of the first and second material streams within said body portion, wherein each of said feed channels has a feed inlet for allowing the second material stream to enter said feed channels with said feed inlet having a cross-sectional area and with said cross-sectional area of said feed inlet of at least one of said feed channels different than said cross-sectional area of said feed inlet of another one of said feed channels for normalizing a flow rate of the second material stream through said feed channels of said body portion, wherein each of said feed channels have a feed outlet opposite said feed inlet of said feed channels for allowing the second material stream to exit the feed channels with said feed outlet of each of said feed channels having a cross-sectional area and with said cross-sectional area of said feed outlet of at least one of said feed channels different than said cross-sectional area of said feed outlet of another one of said feed channels, wherein said feed channels have a main feed portion between said feed inlet and said feed outlet of said feed channels with said main feed portion of said feed channels having a cross-sectional area and with said cross-sectional area of said main feed portion of at least one of said feed channels larger than said cross-sectional areas of said feed inlet of said feed channels.

2. A heat exchanger for transferring heat between first and second material streams, said heat exchanger comprising: a body portion comprising a thermally conductive material, said body portion comprising; a plurality of vent channels defined through said body portion with said vent channels configured to pass the first material stream through said body portion, a plurality of feed channels defined through said body portion and configured to pass the second material stream through said body portion with said feed channels spaced from and in thermal communication with said vent channels such that at least one of the first and second material streams transfer heat with another one of the first and second material streams within said body portion, wherein each of said feed channels has a feed inlet for allowing the second material stream to enter said feed channels with said feed inlet having a cross-sectional area and with said cross-sectional area of said feed inlet of at least one of said feed channels different than said cross-sectional area of said feed inlet of another one of said feed channels for normalizing a flow rate of the second material stream through said feed channels of said body portion, a wherein each of said vent channels have a vent inlet for allowing the first material stream to enter said vent channels with said vent inlet of said vent channels having a cross-sectional area and with said cross-sectional area of a said vent inlet of at least one of said vent channels different than said cross-sectional area of said vent inlet of another one of said vent channels for normalizing a flow rate of the first material stream through said vent channels of said body portion, wherein each of said vent channels have a vent outlet opposite said vent inlet of said vent channels for allowing the first material stream to exit the vent channels with said vent outlet of each of said vent channels having a cross-sectional area and with said cross-sectional area of said vent outlet of at least one of said vent channels different than said cross-sectional area of said vent outlet of another one of said vent channels, wherein said vent channels have a main vent portion between said vent inlet and said vent outlet of said vent channels with said main vent portion of said vent channels having a cross-sectional area and with said cross-sectional area of said main vent portion of at least one of said vent channels larger than said cross-sectional area of said vent inlet of another one of said vent channels.

3. A heat exchanger as set forth in claim 1, further comprising at least one feed distributor block disposed in series and adjacent said body portion and defining said feed inlet of said feed channels.

4. A heat exchanger as set forth in claim 2, further comprising at least one vent distributor block disposed in series and adjacent said body portion opposite said feed distributor block with said vent distributor block defining said vent inlet of said vent channels.

5. A heat exchanger as set forth in claim 1, wherein said feed inlet of each of said feed channels are spaced from each other linearly, concentrically, and/or radially along said body portion.

6. A heat exchanger as set forth in claim 1, wherein said cross-sectional area of said feed inlet of said one of said feed channels is reduced proportionally to a difference between an average flow rate of the second material stream through said feed channels and an actual flow rate through said one of said feed channels.

7. A heat exchanger as set forth in claim 1, wherein said thermally conductive material of said body portion is selected from the group of carbon, graphite, carbon fiber, ceramic, ceramic matrix composite, and metals.

8. A heat exchanger as set forth in claim 1, wherein the cross-sectional area of said feed inlet is below about 0.5 square inches.

9. A reactor system for processing a feed gas, said reactor system comprising:

a reaction chamber having an entrance port for introducing a second material stream comprising the feed gas into said reaction chamber and an exhaust port for exhausting a first material stream from the reaction chamber after processing of the feed gas of the second material stream, a heat exchanger a for transferring heat between first and second material streams, said heat exchanger comprising: a body portion comprising a thermally conductive material, said body portion comprising; a plurality of vent channels defined through said body portion with said vent channels configured to pass the first material stream through said body portion, a plurality of feed channels defined through said body portion and configured to pass the second material stream through said body portion with said feed channels spaced from and in thermal communication with said vent channels such that at least one of the first and second material streams transfer heat with another one of the first and second material streams within said body portion, wherein each of said feed channels has a feed inlet for allowing the second material stream to enter said feed channels with said feed inlet having a cross-sectional area and with said cross-sectional area of said feed inlet of at least one of said feed channels different than said cross-sectional area of said feed inlet of another one of said feed channels for normalizing a flow rate of the second material stream through said feed channels of said body portion, wherein each of said feed channels have a feed outlet opposite said feed inlet of said feed channels for allowing the second material stream to exit the feed channels with said feed outlet of each of said feed channels having a cross-sectional area and with said cross-sectional area of said feed outlet of at least one of said feed channels different than said cross-sectional area of said feed outlet of another one of said feed channels, wherein said feed channels have a main feed portion between said feed inlet and said feed outlet of said feed channels with said main feed portion of said feed channels having a cross-sectional area and with said cross-sectional area of said main feed portion of at least one of said feed channels larger than said cross-sectional areas of said feed inlet of said feed channels.

10. A heat exchanger for transferring heat between first and second material streams, said heat exchanger comprising: a body portion comprising a thermally conductive material, said body portion comprising; a plurality of vent channels defined through said body portion with said vent channels configured to pass the first material stream through said body portion, a plurality of feed channels defined through said body portion and configured to pass the second material stream through said body portion with said feed channels spaced from and in thermal communication with said vent channels such that at least one of the first and second material streams transfer heat with another one of the first and second material streams within said body portion, wherein each of said feed channels has a feed inlet for allowing the second material stream to enter said feed channels with said feed inlet having a cross-sectional area and with said cross-sectional area of said feed inlet of at least one of said feed channels different than said cross-sectional area of said feed inlet of another one of said feed channels for normalizing a flow rate of the second material stream through said feed channels of said body portion, wherein each of said feed channels have a feed outlet opposite said feed inlet of said feed channels for allowing the second material stream to exit the feed channels with said feed outlet of each of said feed channels having a cross-sectional area and with said cross-sectional area of said feed outlet of at least one of said feed channels different than said cross-sectional area of said feed outlet of another one of said feed channels, wherein said feed channels have a main feed portion between said feed inlet and said feed outlet of said feed channels with said main feed portion of said feed channels having a cross-sectional area and with said cross-sectional area of said main feed portion of at least one of said feed channels larger than said cross-sectional areas of said feed inlet of said feed channels, wherein each of said vent channels have a vent inlet for allowing the first material stream to enter said vent channels with said vent inlet of said vent channels having a cross-sectional area and with said cross-sectional area of a said vent inlet of at least one of said vent channels different than said cross-sectional area of said vent inlet of another one of said vent channels for normalizing a flow rate of the first material stream through said vent channels of said body portion, wherein each of said vent channels have a vent outlet opposite said vent inlet of said vent channels for allowing the first material stream to exit the vent channels with said vent outlet of each of said vent channels having a cross-sectional area and with said cross-sectional area of said vent outlet of at least one of said vent channels different than said cross-sectional area of said vent outlet of another one of said vent channels, wherein said vent channels have a main vent portion between said vent inlet and said vent outlet of said vent channels with said main vent portion of said vent channels having a cross-sectional area and with said cross-sectional area of said main vent portion of at least one of said vent channels larger than said cross-sectional area of said vent inlet of another one of said vent channels.

11. A heat exchanger as set forth in claim 10, further comprising at least one feed distributor block disposed in series and adjacent said body portion and defining said feed inlet of said feed channels.

12. A heat exchanger as set forth in claim 11, further comprising at least one vent distributor block disposed in series and adjacent said body portion opposite said feed distributor block with said vent distributor block defining said vent inlet of said vent channels.

13. A heat exchanger as set forth in claim 10, wherein said feed inlet of each of said feed channels are spaced from each other linearly, concentrically, and/or radially along said body portion.

14. A heat exchanger as set forth in claim 10, wherein said cross-sectional area of said feed inlet of said one of said feed channels is reduced proportionally to a difference between an average flow rate of the second material stream through said feed channels and an actual flow rate through said one of said feed channels.

* * * * *